US005897310A

United States Patent [19]

Trueman et al.

[11] Patent Number: 5,897,310

[45] Date of Patent: Apr. 27, 1999

[54] FURNACE RIDER BAR ASSEMBLY

[75] Inventors: Norman Anthony Trueman, Stonyfell, Australia; Geoffrey Ronald Reed, Tadworth; William Robert Laws, Dorking, both of United Kingdom

[73] Assignee: Advanced Materials Enterprise Pty, Australia

[21] Appl. No.: 08/945,603

[22] PCT Filed: Apr. 29, 1996

[86] PCT No.: PCT/AU96/00245

§ 371 Date: Oct. 28, 1997

§ 102(e) Date: Oct. 28, 1997

[87] PCT Pub. No.: WO96/34243

PCT Pub. Date: Oct. 31, 1996

[30] Foreign Application Priority Data

Apr. 28, 1995 [AU] Australia ..... PN2615

[51] Int. Cl.[6] ..... F27D 3/02

[52] U.S. Cl. ..... 432/234; 432/127

[58] Field of Search ..... 432/234, 233, 432/127, 246

[56] References Cited

U.S. PATENT DOCUMENTS

| | | | |
|---|---|---|---|
| 3,985,496 | 10/1976 | Eickelberg | 432/122 |
| 4,368,038 | 1/1983 | Bourdon et al. | 432/253 |
| 4,689,009 | 8/1987 | Heuss | 432/234 |
| 4,747,775 | 5/1988 | Takagi et al. | 432/234 |
| 5,136,610 | 8/1992 | Heuss | 432/233 |
| 5,271,610 | 12/1993 | Klotz | 432/234 |
| 5,284,440 | 2/1994 | Campbell, Jr. et al. | 432/234 |
| 5,288,228 | 2/1994 | Fujita et al. | 432/234 |

FOREIGN PATENT DOCUMENTS

| | | |
|---|---|---|
| 0274807 A1 | 7/1988 | European Pat. Off. . |
| 0463290 A1 | 1/1992 | European Pat. Off. . |
| 0572295 A1 | 12/1993 | European Pat. Off. . |
| 2430490 A1 | 1/1976 | Germany . |
| 61-261421 | 11/1986 | Japan . |
| WO 81/03537 | 12/1981 | WIPO . |

*Primary Examiner*—Teresa Walberg
*Assistant Examiner*—Gregory A. Wilson
*Attorney, Agent, or Firm*—Wolf, Greenfield & Sacks, P.C.

[57] ABSTRACT

Rider bar assembly for a product support beam of a reheat furnace of the type suitable for reheating steel product such as slabs, blooms, bar stock and semi-finished products. The assembly has a rider bar which defines an upper contact surface on which a product to be heated is receivable, a base component which has an upper region with which a lower region of the rider bar is contiguous and support means by which the base component and the rider bar thereon are mountable on a product support beam of the furnace in which the product is to be reheated. The rider bar is formed of a high temperature resistant, solid ceramic material which is a low porosity and which has sufficient compressive strength for supporting part of the load of the product when the letter is received thereon and also on the rider bar of other assemblies mounted on the same and other beams. The base component is formed of a solid ceramic material which also has high temperature resistance and a compressive strength sufficient for supporting that part of the product load. The ceramic material of which the base component is formed has a low thermal conductivity whereby conduction of heat energy from the product, to the beam on which the assembly is mounted, is reduced.

17 Claims, 5 Drawing Sheets

FURNACE RIDER BAR ASSEMBLY

FIELD OF THE INVENTION

This invention relates to an improved product support system for a walking beam re-heat furnace.

BACKGROUND OF THE INVENTION

Steel product, such as slabs, blooms, bar stock and semi-furnished products are re-heated prior to hot working to produce hot rolled steel products. One conventional form of furnace used for such re-heating has been a low output top-fired furnace in which product to be heated sit on a refractory hearth; with the product conveyed through the furnace by pushers. Such furnaces have been improved to achieve higher outputs, by utilising top and bottom firing to reduce the time required for conduction of heat energy in the product to achieve a uniform temperature throughout the product.

A more recent development is the so-called walking beam furnace. This offers several advantages over the pusher furnace. The present invention principally is concerned with improvements applicable to the walking beam furnace. However, the invention can be used in at least some forms of pusher furnaces.

One benefit of the walking beam furnace is that it is self-conveying. This is achieved by having several fixed beams, extending through the furnace from the front or inlet to its exit, and several moving beams substantially parallel to the fixed beams. Product to be re-heated is supported on the fixed beams at successive locations along their length. The moving beams are actuated by hydraulic cylinders located under the heating chamber of the furnace, so as to be movable from, and back to, a lowered or ambush position so as to lift and index product forward, as required, from one to a next position on the fixed beams.

There was a major advance in walking beam furnaces in the mid-1960's when the Surface Combustion Co. of the United States of America developed a top- and bottom-fired furnace with moving beams comprising water-cooled lifting rails. This provided for supporting product alternately, and for substantially equal intervals, on the moving and stationary beams of the walking beam conveyor system. Also, by suitable design of support structure of the beams, it was possible to heat thick product slabs without the need for a soaking refractory hearth. Such hearth was used in pusher furnaces, and in early forms of walking beam furnaces, to enable regions of the lower surface of the product, cooled by contact with the support structure, to attain overall temperature uniformity throughout the product.

Over the last thirty (30) years, almost all new re-heating furnaces have been of the walking beam type. It is believed that about 50% of all furnaces for re-heating steel product are of that type, with about two hundred (200) such furnaces currently in operation throughout the world.

In the fixed and moving beams of the furnace based on the Surface Combustion Co. furnace, and in developments thereof, the water-cooled lifting rails comprising the beams have rider or skid bars mounted thereon. While designated as bars, the rider or skid bars can be of a variety of forms. Those based on the 1960's developments are in the form of buttons or cylinders about 75 mm high, 50 mm in diameter and located at about 300 mm spacing along the beam. However, other forms of rider bars in use are more rectangular in plan view, such as about 35 mm transversely, and about 140 mm longitudinally, of the beam and at a closer pitch interval so as to more closely resemble continuous rider bars. Usually, the rider bars are detachably mounted on their water-cooled pipes. This form of mounting may, for example, be by steel keeper plates which are welded to the pipe, and which are able to be ground off when replacement of rider bars is required.

The water-cooling of the pipes comprising the fixed and moving beams have a large cooling effect in the lower region of the furnace chamber. To reduce this, the cooled beams are insulated by shaped refractory insulation which encloses the beams except along the line of its rider bars. However, the insulation shields the bottom surface of the product from heating burner flames, thereby causing cold spots in the product. Also, as the product becomes hotter during its passage through the furnace, there is a further cooling effect as heat is conducted from the product to the beams, through the rider bars.

In an effort to increase furnace efficiency, there has been a trend towards operating the water-cooled pipes as part of an evaporative boiler system. In this way, steam can be generated in the pipes, and it can be used for process purposes elsewhere in the plant in which the furnace is located, or to generate electric power through a steam turbine. Even so, pipe temperatures are raised by only about 60° C. above temperatures attained in water-cooled systems and, while this benefits overall energy utilisation, it has little effect on the problem of shielding of the product by pipe insulation and subsequent conductive cooling caused by the rider bars of the bottom surfaces of product being re-heated. As will be appreciated, cold spots on the product bottom surface result in imperfections in subsequent rolling of the product.

The design of the rider bars, and their attachable mounting on the pipes, can reduce the problem of conduction of heat from the product to a degree, relative to continuous rider bars integral with their pipes. Also, the spacing between rider bars relative to the distance through which the product is moved or indexed by the movable beams can, in some arrangements, vary the location at the bottom surface of the product at which heat loss by conduction occurs. However, the rider bars are of temperature resistant steel, frequently of high cost, high cobalt steels, such as with 30 to 50% cobalt. An example of a suitable metal is that available under the trade mark UMCO. The rider bars therefore inherently have a high thermal conductivity which precludes features of design and spacing from being able to significantly reduce the problem of thermal conduction.

SUMMARY OF THE INVENTION

The present invention is directed to providing an improved form of rider bar assembly, suitable for use with fixed and moving beams of a walking beam furnace and at least some forms of pusher furnaces. The invention also extends to a walking beam furnace in which the beams are provided with such rider bar assembly.

The rider bar assembly of the invention has a rider bar which defines an upper contact surface on which a product to be reheated is receivable, a base component which has an upper region with which a lower region of the rider bar is contiguous, and support means by which the base component and the rider bar thereon are mountable on a product support beam of a furnace in which the product is to be reheated. The rider bar is formed of a high temperature resistant, solid ceramic material which is of low porosity and which has a sufficient compressive strength for supporting part of the load of the product when the latter is received thereon. The base component is formed of a ceramic material which also is solid and has a compressive strength sufficient for supporting that part of the product load. The ceramic material of the base component additionally has high temperature resistance, and a low thermal conductivity whereby conduction of heat energy from the product to a beam on which the assembly is mounted is reduced.

The beam on which the assembly is mountable preferably is a fixed or moving beam of a walking beam furnace. However, the beam may be one of a pusher furnace. As will be appreciated in each case, the beam on which the assembly is mountable is one of a plurality of beams which extend in parallel from the inlet to the outlet end of the furnace. The beams provide support for product in the furnace during reheating. Typically the product is of elongate form, and is disposed transversely with respect to the beams with a number of beams supporting the product.

The contiguous regions of the rider bar and base component preferably are substantially horizontally disposed with the assembly appropriately mounted on a furnace beam. The regions may be substantially planar. Alternatively, they may be of stepped, complementary form and have parts thereof which are substantially horizontal and planar. The stepped arrangement can be such that the regions interfit, such as in a tongue and groove or dove-tail configuration. However, in each case, the regions most preferably are contiguous such that a load applied by the product is able to be accommodated so as to avoid or minimise any lateral forces being generated between the rider bar and the base component.

The base component has a lower surface which preferably is substantially horizontally disposed with the assembly appropriately mounted on a furnace beam. This also is to minimise or avoid lateral forces.

The support means may have an upwardly facing surface on which the lower surface of the base component is received. That surface preferably is substantially planar and disposed such that, with the assembly appropriately mounted on a furnace beam, the mounting means surface and the lower surface of the base component are substantially horizontally disposed and in surface to surface contact.

While the support means may have a surface on which the base component is received, this is not necessary. Rather the mounting means may be such that a lower surface of the base component is able to be supported by an upper surface of the beam. In the latter case, the lower surface of the component and the upper surface of the beam preferably are substantially horizontally disposed and in surface to surface contact.

The support means is adapted to be mounted on the beam to secure the assembly in a required position. This securement may be by means of welding of the support means to the beam and/or by retaining clamps or bolts.

The upper surface of the rider bar preferably is substantially planar. This surface also preferably is substantially horizontal with the assembly appropriately mounted on a furnace beam. However, the upper surface of the rider bar can be of other forms, such as convex transversely of the beam, subject to the surface being of substantially uniform curvature and thereby avoiding lateral forces.

As will be appreciated, a plurality of furnace beams typically extend along a lower region of a furnace in a direction of product travel during reheating. Each beam typically will have a plurality of longitudinally spaced or adjacent rider bar assemblies for supporting the product on the beams. Reference to the assembly being appropriately mounted also will be understood as designating mounting in which the assembly is upstanding on the beam, preferably substantially vertically. Also, reference to lateral forces, and to convex transversely in the case of rider bar upper surface, is relative to the longitudinal extent of the assembly.

The contiguous regions of the rider bar and the base component may define respective abutting surfaces. In such case the rider bar may be separable from the base component. However, the rider bar and the base component may be secured in assembly, such as by diffusion or reaction bonding therebetween, or by pinning. The securement may be such that the rider bar has a distinct lower surface by which it is secured to a distinct upper surface of the base component. However, there alternatively may be a transition zone between the rider bar and the base component which results from their securement, such as in the case of diffusion bonding.

The rider bar of the assembly may be of a densified ceramic which preferably is of low porosity, such as results from attaining a density in excess of 95% of the theoretical density, to achieve high strength at the operating temperature and to resist corrosion. However, the ceramic can be produced by a number of processes including pressureless sintering, hot pressing, hot isostatic pressing, reaction bonding, infiltration processes or recrystallisation. Suitable materials of which the rider bar can be formed include silicon carbide, and various grades of Sialon (ceramics based on Si—Al—O—N). However, a variety of other ceramic materials can be used.

Principal requirements for suitable materials for use in forming the rider bar are:

(a) an ability to operate at a temperature of up to about 1250° C. and, in some instances, up to 1300° C. or even 1350° C., without significant degradation;

(b) sufficient compressive strength and fracture toughness, so as to be able to withstand product loads in use;

(c) sufficient abrasion resistance; and (d) resistance to attack by hot scale or slag.

At least some forms of sintered silicon carbide are particularly suitable for producing rider bars which comply with these requirements but, as indicated, other forms of silicon carbide, Sialon and other ceramic materials also can be used for producing suitable rider bars. In the case of ceramic materials, such as certain forms of silicon carbide, which have a level of thermal conductivity at least equal to that of steel, the adverse consequence of such high thermal conductivity is offset by the base component of ceramic material required by the invention. The base component substantially reduces thermal conduction, via the rider bar, from a product being re-heated to a beam on which the product is supported by the rider bar. Also, the base component facilitates use of a rider bar of a lesser thickness, a benefit which is of particular importance where the rider bar is of a costly sintered ceramic.

There can be an additional benefit where the chosen sintered ceramic for the rider bar has a thermal conductivity substantially less than steel. That is, the conductivity of the ceramic can be such as to reduce heat loss from the product to the beam. This benefit is not available with all suitable ceramics, since some of these have a relatively high level of thermal conductivity. Some forms of silicon carbide for example have a thermal conductivity similar to that of steel at 800° C., but about four times greater than steel at 100° C.

The costs of some ceramics, such as some forms of silicon carbide, are of a similar order to that of high cobalt steels per unit weight. However, suitable ceramics usually have a low density compared with steel, for example a density of about 3.1 to 3.2 for sintered or hot pressed silicon carbide compared with about 7.2 for cobalt steel. Thus, on a volume for volume basis, a significantly lesser weight of ceramic is required, relative to a steel, with a corresponding lower effective cost of the ceramic.

The base component has a strength substantially in excess of that of a green body. The base component may have a relatively low density and, as a result, a relatively high level of porosity, such as a density of in excess of 70% of theoretical and, hence, a porosity up to about 30%. However, the base component preferably is substantially fully densified, such as to a level in excess of about 95% of theoretical density. The required relatively low thermal conductivity of the base component is to result at least in part from the inherent nature of the ceramic material in question. To a degree, the influence of inherent low thermal conductivity needs to increase with decreasing porosity, since porosity contributes to attaining a required level of thermal conductivity.

The base component can serve two useful functions. The first of those is that already described, of thermally insulating the rider bar from the beam on which it is mounted. The second function is to provide a shock absorbing action between the rider bar and the beam, to safeguard the rider bar against stress fracture such as when product to be re-heated is unevenly loaded on a plurality of rider bar assemblies or uneven loading results from sagging of the product during its reheating.

Alumina is particularly suitable for use as the base component. However other ceramics can be used.

The support means can vary in form, but is to locate and secure the rider bar on the base layer and the base component on a beam. The support means may comprise a pair of support plates each of which extends along a respective side of the assembly which, with the assembly mounted on its beam, extends longitudinally of the beam. Alternatively, the support means may enclose at least a lower portion of the base component along all sides of the assembly. In the latter case, the support means preferably is of integral form, while it preferably encloses the base component along all sides and enclose a lower portion of the rider bar at least along respective sides of the rider bar which extend longitudinally of the beam.

The support means may be of integral form and recessed so as to locate and receive therein at least a lower portion of the base component, but it preferably receives therein the full height of that component and a lower portion of the rider bar. The recess may enclose the base component and the lower portion of the rider bar on all sides of the assembly. The recess may have upwardly projecting, opposed side walls which extend along sides of the assembly which are to extend longitudinally of the beam.

As indicated, conventional rider bars suffer from the disadvantage of producing cold spots in product being reheated. This results from the conduction of heat energy from regions of the lower surface of the product at which it rests on the rider bars. The rider bar assembly of the present invention enables this problem to be substantially reduced since the base component restricts conduction of heat energy from the rider bar to the support means and/or the beam. Thus, even if the rider bar itself has a high level of thermal conductivity, enabling it to achieve a temperature close to that of product thereon, the base component insulates the rider bar and restricts heat energy conduction from it.

With conventional rider bars, cold spots also result from their relatively low height. This is because the beam and its insulation is in close proximity to the lower surface of the product. The beam and its insulation thus creates a shadow effect, restricting the passage of heat energy from bottom burners of the furnace to the product. Attempts therefore have been directed to using taller rider bars, so as to minimise the shadow effect. However, taller rider bars of expensive high cobalt alloy substantially increase the quantity of the alloy used, and this substantially increases the costs. In contrast, the rider bar assembly of the present invention is well suited to being made in taller forms, as this is enabled by use of a base component of greater depth and an increase in depth of the support means, without the need to increase the depth of the rider bar. Thus, where for example the rider bar is of silicon carbide, the base component is of alumina and the support means is of mild steel, a taller assembly is obtainable by a corresponding increased usage of relatively low cost alumina and mild steel, rather than of more costly silicon carbide.

With a fixed or moving beam of a walking beam furnace provided with a rider bar assembly according to the invention, the beam usually comprises a pipe enabling water-cooling. The pipe necessitates the provision of insulation around its circumference, below the rider bar assembly, and the insulation material can be similar to that conventionally used. However, the assembly preferably includes means which modify heat transfer between the product being re-heated and the assembly. The modifying means may vary, depending on whether the assembly is one used at an inlet end region of a furnace where the first phase of re-heating commences, or one used at a region of the furnace beyond the inlet region.

For an assembly at either region of the furnace, the modifying means includes, at each side of the assembly which is to extend longitudinally of the pipe, a respective pad of high temperature resistant, thermally conducting material. The pads preferably abut the mounting means and are mutually inclined so as to diverge from each other, in a direction away from the rider bar. With the assembly mounted on its pipe, each pad may be secured between a respective side of the mounting means and an abutment provided on the pipe, such that the pad is spaced from the pipe. A resultant cavity between the pad and the pipe may provide an insulating air space. However, it is preferred that the cavity is filled by insulating material. The pads may be formed of steel or, as preferred, of a thermally conductive ceramic. Where the pads are formed of a ceramic, this preferably is the same as, or similar to, the ceramic material used for rider bar where the latter material has a high conductivity. The insulating material may be the same as, or similar to, that used to insulate the pipe, or it may be the same as, or similar to, the ceramic material use for the base component.

Where the assembly is to be used in an inlet region of a furnace, the pads are mutually inclined at an included angle which is substantially less than for an assembly to be used beyond the inlet region. In the former case, the included angle may be about 50 to 60°, whereas in the latter case, the angle may be about 80 to 95°.

With an assembly for either region of a furnace, the insulation provided around the pipe preferably extends from adjacent a side of one pad which is remote from the rider bar, to adjacent the corresponding side of the other pad. In each case, the pipe insulation preferably is substantially flush with the outer surface of each pad, ie. its surface remote from the other pad. To achieve this, in the case of an assembly to be used at an inlet region, the pipe insulation preferably decreases in thickness towards each pad in a respective quadrant of the pipe in which a pad is located. As a consequence, the insulated pipe and its rider bar assembly increases exposure of the bottom surface of product being re-heated to the flame and radiation from a bottom burner of the furnace, facilitating heating of the product in the vicinity of the assembly. Also, the thermal conductivity of the pads results in them taking up heat energy from the bottom burner, with this being conducted to the rider bar, contributing to a reduction of heat loss from the product to the rider bar. This conduction of heat energy also results in heating of the mounting means, but transfer of heat energy from the mounting means to the pipe preferably is minimised by there being only localised contact between the mounting means and the pipe, such as at the site of spot welds.

In the case for an assembly at other regions, the greater included angle between the plates enables the pipe insulation to be of uniform thickness for maximum insulation of the pipe. In such regions, the product will have attained a temperature at which obstruction of a bottom burner flame or radiation by the insulation is of lesser concern. Again, the thermally conductive pads are able to conduct heat energy via the mounting means to the rider bar, reducing the capacity of the rider bar to extract heat energy from the product. As a consequence, the rider bar attains a temperature close to that of the product, so that the tendency for generation of a cold spot where it contacts the bottom surface of the product is greatly reduced.

BRIEF DESCRIPTION OF THE DRAWINGS

In order that the invention may more readily be understood, description now is directed to the accompanying drawings, in which.

DESCRIPTION OF THE PREFERRED EMBODIMENTS

Figure 1:
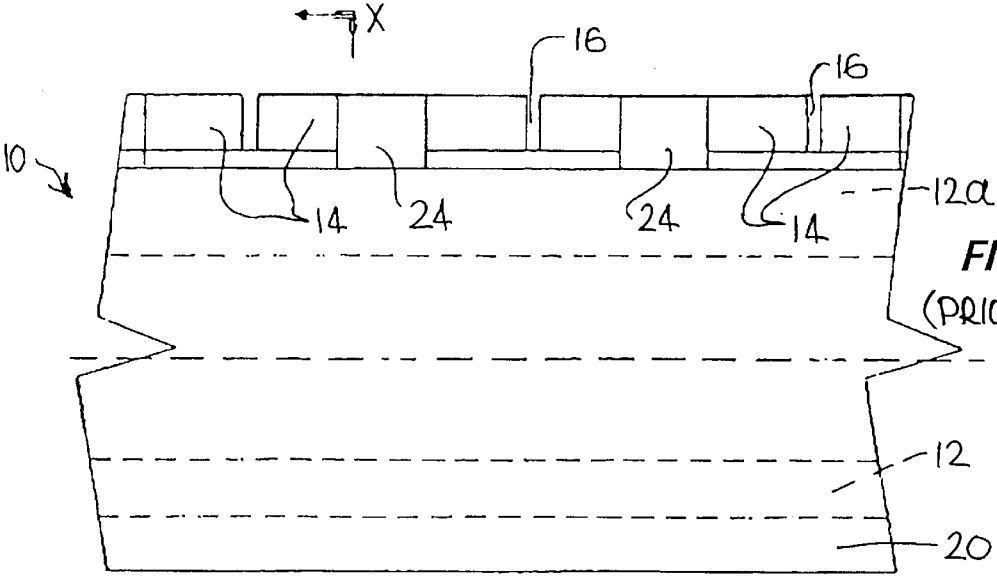
FIG 1 (PRIOR ART)
FIG. 1 is a side elevation of a known prior art arrangement of a beam, for a walking beam furnace, having a conventional rider bar.
Figure 2:
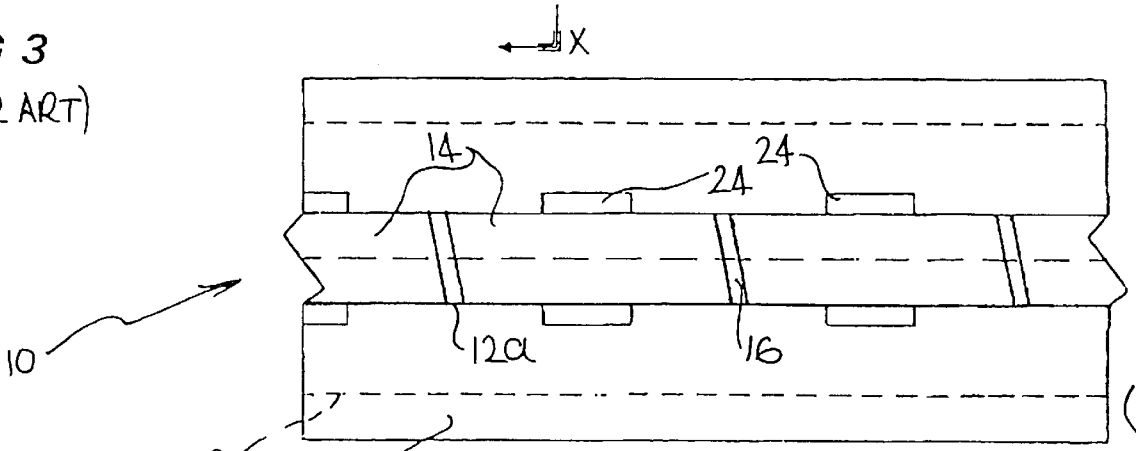
FIG 2 (PRIOR ART)
FIG. 2 is a top plan view of the prior art arrangement of FIG. 1.
Figure 3:
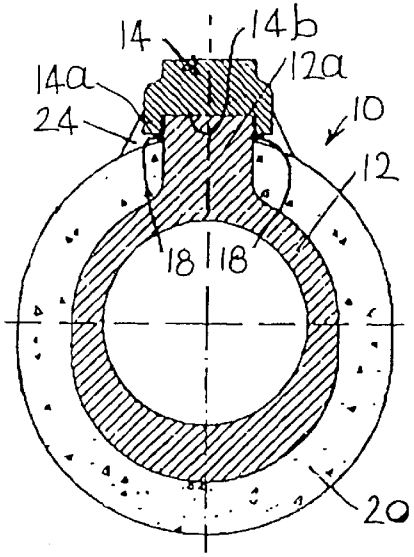
FIG 3 (PRIOR ART)
FIG. 3 is a sectional view taken on respective line X—X of FIG. 1.

With reference to FIGS. 1 to 3, the prior art beam arrangement 10 includes a water-cooled pipe 12 of carbon steel which comprises the beam, and a series of rider bars 14. The pipe 12 has a fin 12*a* on which bars 14 are mounted. The bars 14 are of a heat resistant alloy steel, such as a high cobalt steel with, for example, 30 to 50% cobalt, capable of operating at temperatures up to about 1000° C. with cooling water flow-through pipe 12. In use, bars 14 reach high temperatures and, as their thermal expansion co-efficient is greater than that of pipe 12, their expansion is allowed for by providing a series of bars 14, with gaps 16 therebetween, rather than a continuous rider bar.

The bars 14 have depending side flanges 14*a* between which a groove 14*b* is defined along their lower face. The top of fin 12*a* fits in groove 14*b* to locate bars 14. Also, bars 14 are welded to fin 12*a* at their longitudinal centre regions of flanges 14*a*, as shown by welds 18, which allows their expansion in each longitudinal direction. The arrangement is completed by fitting a preformed insulating sleeve 20 around pipe 12, so as to enclose the latter up to the sides of fin 12*a*. Also, the top surface of sleeve 20 is grouted with castable refractory 24 to seal cracks to prevent attack by hot scale and/or slag in the hottest parts of a furnace.

With the prior art arrangement of FIGS. 1 to 3, the rider bars 14 are in direct contact with fin 12*a*. Thus, the arrangement enables a substantial flow of thermal energy from product supported on bars 14 to pipe 12. This flow of thermal energy is from the product to bars 14, and from the bars 14 direct to fin 12*a*, and pipe 12. The resultant loss of heat energy is exacerbated by the flow of cooling water through pipe 12, with this flow being necessary to protect pipe 12 against high prevailing furnace temperatures.

Figure 5:
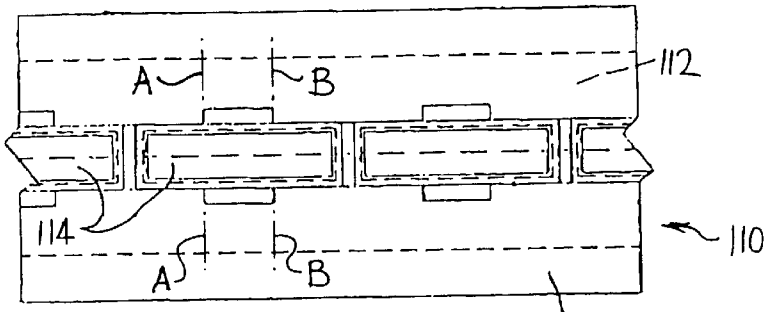
FIGS. 4 and 5 correspond to FIGS. 1 and 2, but show a beam having a rider bar assembly according to a first form of the invention.
Figure 4:
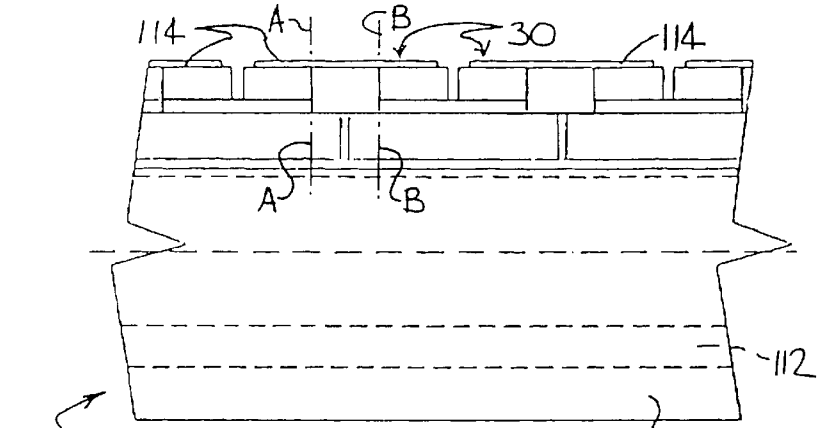
Figure 6:
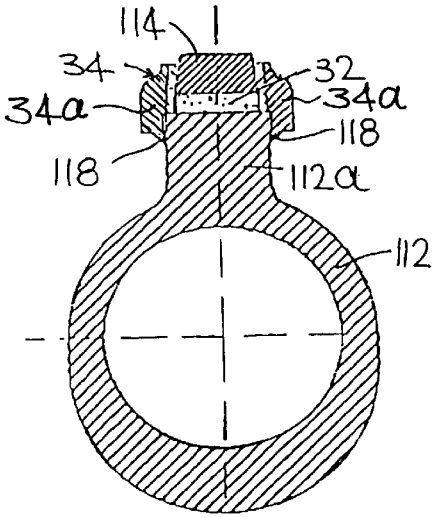
FIG. 6 corresponds to FIG. 3, but shows the assembly of the first form of the invention, without an insulating sleeve.

In FIGS. 4 to 6, parts corresponding to those of FIGS. 1 to 3 are identified by the same reference numeral, plus 100. In the form of the invention shown in FIGS. 4 to 6, the arrangement 110 has a longitudinal series of rider bar assemblies 30 in accordance with the invention mounted on fin 112*a* of tube 112. Each assembly 30 has a rider bar 114, but each of bars 114 is spaced above fin 112*a* by a base component 32 of a ceramic material of low thermal conductivity. The bars 114 preferably are of high density sintered silicon carbide, although they may be of other sintered ceramic material such as Sialon. Components 32 preferably comprise sintered pads comprising a ceramic material, such as alumina, of a sufficient compression strength for accommodating part of the weight of a product resting on bars 114. Each component 32 is of a ceramic which restricts thermal conduction between its bar 114 and fin 112*a*. However, components 32 also act to absorb shock loading when a product is lowered onto bars 114 of arrangement 110. There is a further advantage in that components 32 can deform to a degree to act as load equalisers to reduce stress induced in bars 114 when under load, minimising risk of fracturing the relatively more brittle material of bars 114.

Each component 32 and a lower portion of its bar 114 are contained within a respective mounting means comprising a casing 34 of low alloy steel which is welded at 118 to fin 112*a*. Also, while not shown in FIG. 6, a sleeve 120 corresponding to sleeve 20 of FIGS. 1 to 4, is provided around pipe 112.

Each casing 34 can simply comprise a pair of bars 34*a* when base component 32 is of relatively low porosity sintered ceramic material. However, each casing 34 preferably encloses component 32 on all four sides, that is, both longitudinally and transversely of fin 112*a* as shown.

Figure 7:
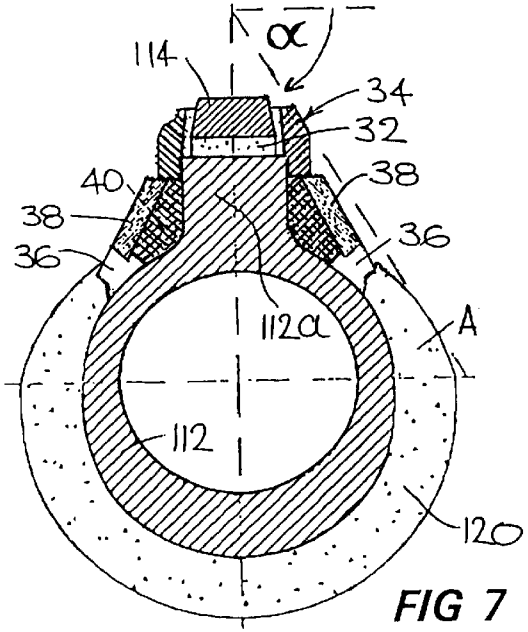
FIG. 7 corresponds to FIG. 6 but shows a second form of the invention.
Figure 8:
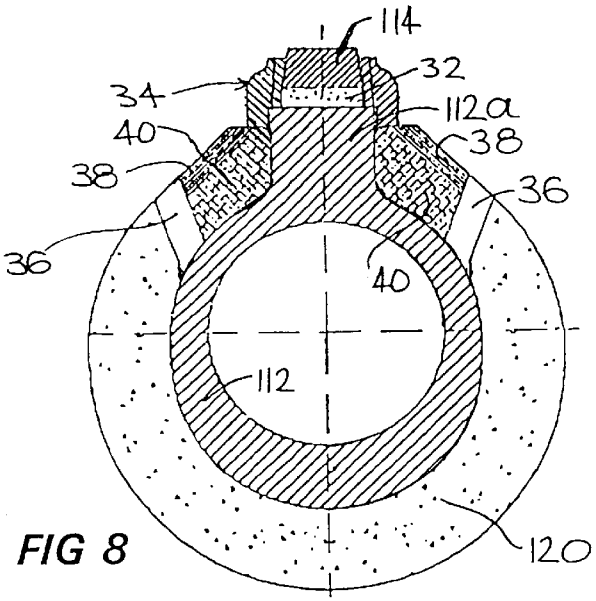
FIG. 8 corresponds to FIG. 6, but shows a third form of the invention.

A respective variant of arrangement 110 of FIG. 6 is shown in each of FIGS. 7 and 8. As shown for each variant, high temperature resistant alloy pins 36 are welded to pipe 112, to each side of fin 112*a* and below casing 34. Between each pin 36 and the adjacent side of casing 34, a pad 38 of high thermal conductivity is secured in spaced relationship to pipe 112 and its fin 112*a*. A cavity at the back of each pad 38 is filled with material 40 which comprises insulation or refractory material of low thermal conductivity. The pads 38 preferably are of silicon carbide, while material 40 may be grout, or the same as, or similar to, the material used for sleeve 20, or it may be the same as, or similar to, the material used for layer 34.

The respective arrangements of FIGS. 7 and 8 differ in the inclination of pads 38 and in the shaping of sleeve 120. In FIG. 7, the pads 38 on opposite sides of fin 112*a* are mutually inclined at a relatively small included angle, such as from 50° to 65°, preferably at about 60°. In FIG. 8, the included angle of from about 80° to 95°, preferably at about 90°. In each case, sleeve 120 is substantially flush with the lower edge of each pad 38. In FIG. 7, this is due to progressive reduction in the radial thickness of sleeve 120 up to each pad 38. In FIG. 8, sleeve 120 is of substantially uniform thickness.

The arrangement of FIG. 7 is appropriate for use in an inlet end region of a furnace. This allows the angle $\alpha$ from the horizontal, of a line from a point on a vertical medial plane above bar 14 and tangential to sleeve 120 at point A, to be a maximum. Thus, the arrangement results in sleeve 120 providing a minimum obstruction of heat energy passing from a bottom burner to product on bar 114. Also, pads 38 are directly heated by heat energy from a bottom burner, and thereby raise the temperature of bar 114 and thereby reduce the capacity of pad 114 to draw heat energy from product thereon. Thus, the tendency for conduction of heat energy from the product, via bars 114 and casing 34 to fin 112 is substantially reduced. Also, component 32 reduces conduction of heat energy from bar 114 to fin 112. The overall effect enhances the input of heat energy to the product, with minimum risk of development of cold spots at a lower surface of a product resting on and in contact with bars 114.

The arrangement of FIG. 6 is appropriate for use in a hotter furnace region beyond the inlet region. Once the product is hot there is greater benefit in the increased thickness of sleeve 120 adjacent to pads 38, to insulate pipe 112. Also, the greater included angle between opposed pads 38 enables a greater depth of insulation material 40 and hence, a reduced risk of heat conduction from pads 38 to pipe 112. However, conduction of heat energy from pads 38 to bar 114, via casing 34, maintains bar 114 at a high temperature, reducing the risk of a cold spot developing in the lower surface of product in contact with bar 114.

Figure 9:
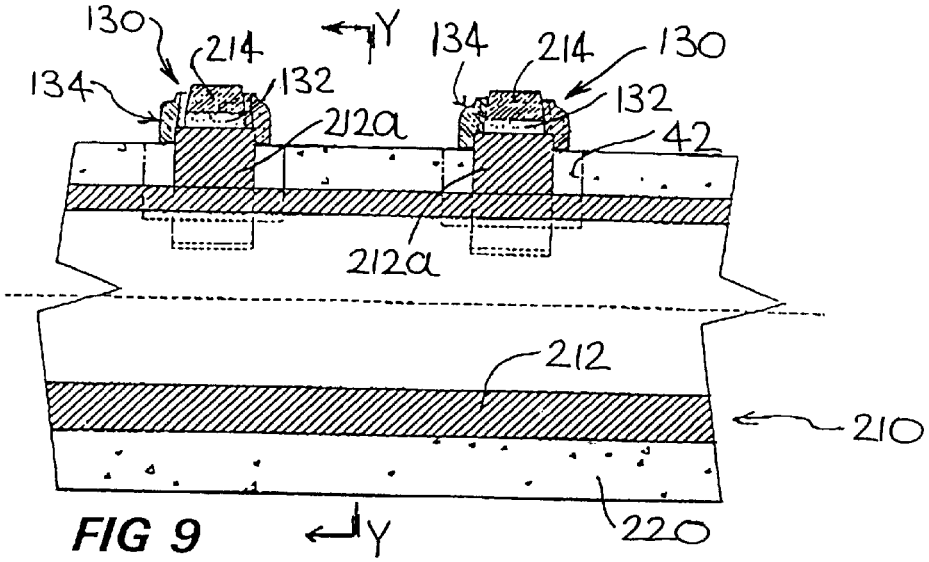
FIGS. 9 to 11 correspond to FIGS. 4 to 6, but show a fourth form of the invention.
Figure 10:
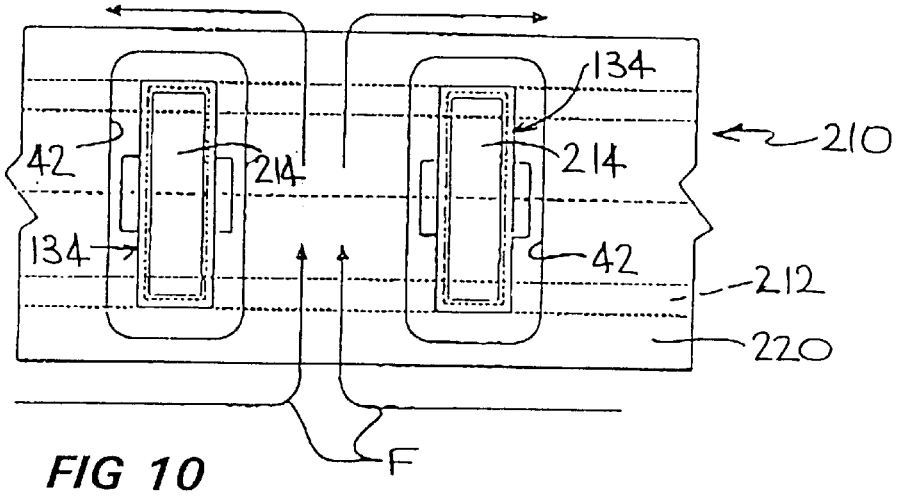
Figure 11:
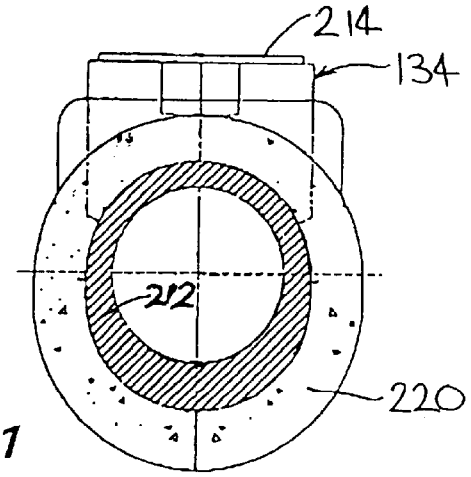

In the fourth form of the invention shown in FIGS. 9 to 11, parts corresponding to those of FIGS. 4 to 6 are identified by the same reference numerals, plus 100. In that fourth form, the arrangement differs from the first form of FIGS. 4 to 6, and from the second and third forms of respective FIGS. 7 and 8, principally in that pipe 212 does not have a single longitudinal fin, but rather a plurality of longitudinally spaced, transverse ribs or fins 212*a*, and in that each assembly 130 is disposed transversely, rather than longitudinally, of pipe 212. Also, fins 212*a* are spaced such that greater gaps are provided between assemblies 130. Moreover, the insulation 220 extends around the full circumference of pipe 212 between successive assemblies 130, with each fin 212*a* and its assembly 130 located in a respective opening 42 in the insulation 220.

The arrangement of FIGS. 9 to 11 does not include pads 38 and insulation 40 as shown in FIGS. 7 and 8. However, if required, these features can be provided by enlarging openings 42 at their transverse sides.

The arrangement of FIGS. 9 to 11 provides similar product support area to the forms shown in FIGS. 6 to 8, but the product heating effect is enhanced still further. Thus, the larger spacing between successive assemblies 130 facilitates circulation of a bottom burner flame, as depicted by arrows F in FIGS. 10. Additionally, as product is walked through the furnace, it is less likely that, during successive support intervals, the same spots of its lower surface will be in contact with rider bars 214.

Figure 12:
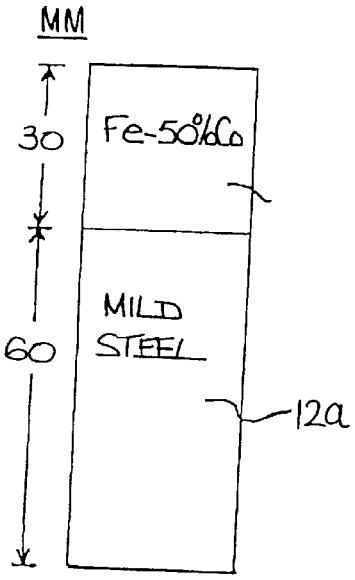
FIG. 12 is a schematic representation of the cross-section of FIGS. 1 and 2, through the rider bar and pipe.
Figure 13:
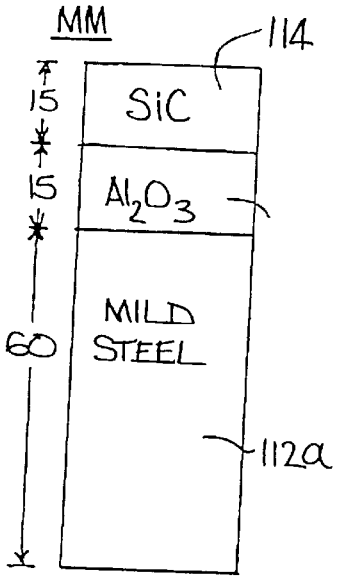
FIGS. 13 and 14 correspond to FIG. 12, but depict alternative sections for the cross-sections of each of FIGS. 6 to 8.
Figure 14:
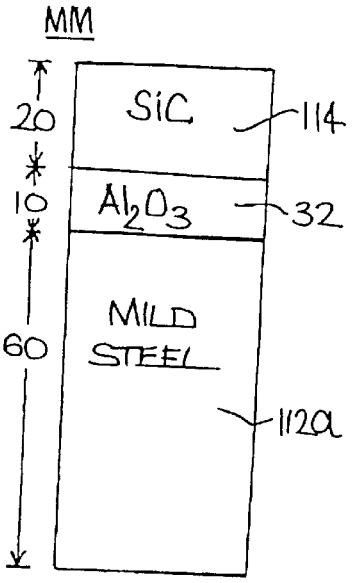

FIG. 12 represents the relative thickness of a bar 14 to the depth of fin 12*a* in the arrangement of FIGS. 1 to 3; based on a bar 14 of 50% cobalt steel which is 30 mm thick on a fin 12*a* which is 60 mm deep. FIGS. 13 and 14 show similar details for respective alternative arrangements based on FIG. 8. In FIG. 13, a 15 mm thick silicon carbide bar 114 is spaced from the top of a 60 mm deep fin 112*a* by a 15 mm sintered alumina layer component; whereas in FIG. 14, the thickness of the bar 114 and component 32 is 20 mm and 10 mm respectively.

Figure 15:
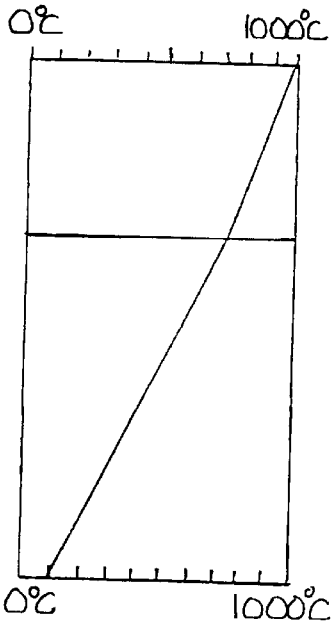
FIGS. 15 to 17 schematically represent temperature distribution and relative heat loss in the respective arrangements for FIGS. 12 to 14.
Figure 16:
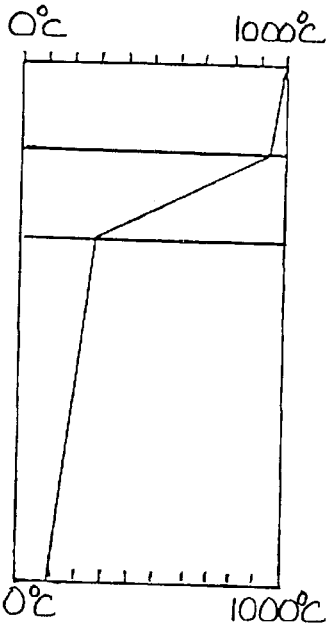
Figure 17:
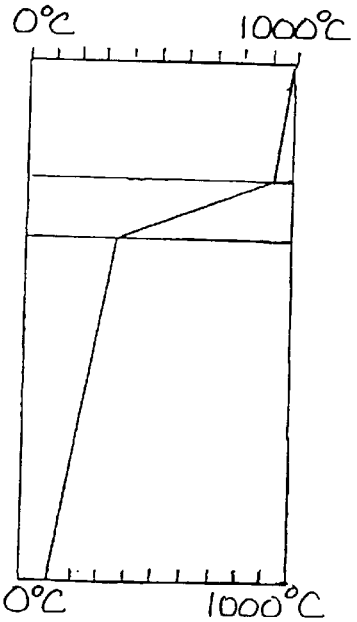

FIG. 15 shows the heat distribution in the arrangement of FIG. 12 on attaining a temperature of 1000° C. at the top surface of pad 14 in contact with product. The temperature decreases from that surface, substantially linearly to the base of fin 12*a*, ie. to the water-cooled pipe 12. The heat loss in FIG. 15 is set at 100% for the purpose of comparison with FIGS. 16 and 17, but of course it is substantially less than this, but significant and such as to result in a cold spot in the product. FIGS. 16 and 17 show the markedly different temperature distribution resulting from the provision of base component 32 between rider bar 114 and fin 112*a*, again after the top surface of bar 114 has attained a temperature of 1000° C. The 15 mm component 32 in the arrangement of FIG. 13 results in the heat loss being only 29% of that obtained with the FIG. 12 arrangement. However, even the 10 mm thickness of layer 32 in the arrangement of FIG. 14 results in a heat loss of only 36% of the loss in the FIG. 12 arrangement.

Figure 18:
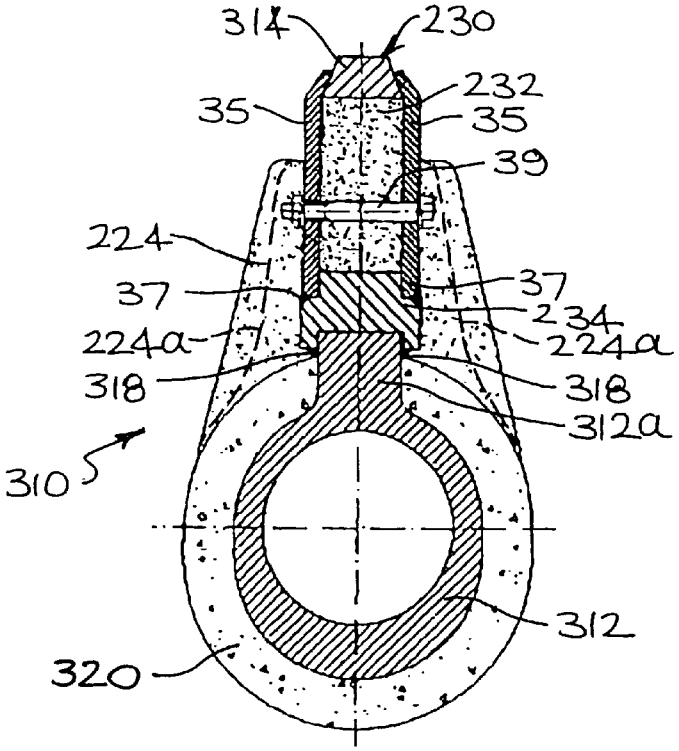
FIGS. 18 and 19 show further respective forms of the invention.
Figure 19:
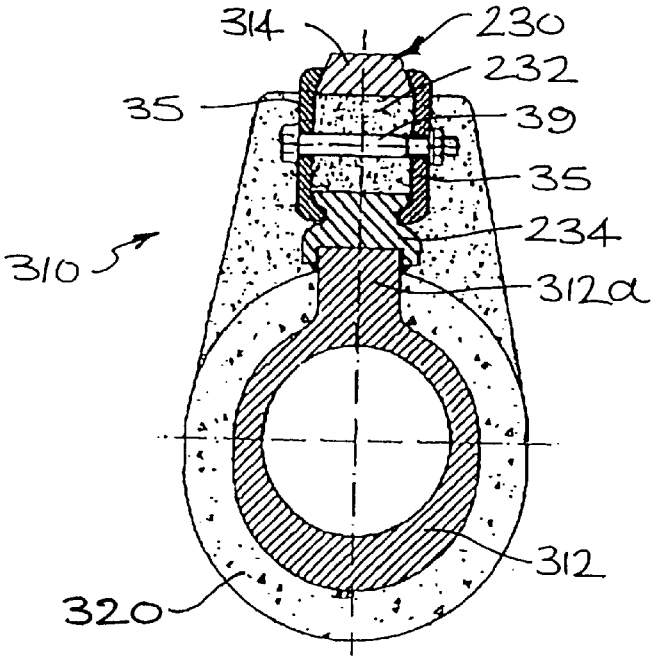

FIGS. 18 and 19 show transverse sectional views of respective further arrangements according to the invention. In plan view and side elevation, these further arrangements of FIGS. 18 and 19 may be similar to that of FIGS. 4 to 6. Parts of the further arrangements corresponding to those of FIGS. 4 to 6 have the same reference numerals, plus 200.

The arrangement 310 of FIG. 18 has a longitudinal series of rider bar assemblies 230 mounted on fin 312*a* of water cooled tubular beam 312. As shown for the one assembly 230 depicted, each assembly has a rider bar 314 and a base component 232 on which bar 314 is mounted. Each assembly has a casing 234 which supports component 232 and bar 314 on fin 312*a* and which is welded at 318 to fin 312*a* to secure assembly 230 on beam 312.

Casing 234 defines a longitudinal groove in its lower surface which accommodates the upper extent of fin 312*a*. Apart from the part of fin received in casing 234, beam 312 is fully enclosed by a preformed insulating sleeve 320. Also, casing 234 is longitudinally stepped at the junction of its upper surface and each side surface to accommodate the lower edge of a respective side plate 35. Each side plate 35 is welded to casing 234 at 37 and has a width between its lower and upper edges so as to extend above the height of component 232 and partially overlap the lower extent of rider bar 314. Thus, component 232 is located between the side plates 35, over at least a part of its extent along beam 312. At least one bolt 39 through plates 35 and a preformed bore through component 232 is provided to strengthen the assembly.

Rider bar 314 has tapered sides. An upper margin of each side plate 35 is inturned so as to engage bar 314 at a respective side, and secure it on component 232.

Grout 224 is applied along each side of assembly 230. The grout merges with the periphery of insulating sleeve 320, and terminates at a mid-height line along each side plate 35.

Assembly 230 differs from previously described forms in that it is substantially higher. In the assembly 30 of FIGS. 4 to 6 and the respective assembly of FIGS. 7, 8 and 9 to 11, the height may be about 30 mm above the upper surface of the fin of the beam. In the case of assembly 230 of FIG. 18, the corresponding height may be significantly greater, such as from about 50 to 70 mm. As a consequence, the shadow effect of beam 312 and its sleeve 320 is substantially reduced. That is, heat energy from a bottom burner of a furnace in which beam 312 and assembly 230 is provided has greater access to product being heated, due to shadow angle $\alpha$ (as shown in FIG. 7) being relatively large. Thus, the tendency for a cold spot to develop in the product, where it rests on bar 314, is minimised while, as in previous forms, this tendency also is reduced by the insulating effect of ceramic component 232.

In order to further reduce the shadow effect, grout 224 can be less bulky than the form shown in FIG. 18. Thus, for example, it may be of lesser thickness, such as by having an outer surface shown by broken line 224*a*.

The arrangement 310 of FIG. 19 will readily be understood from description of the arrangement of FIG. 18. Corresponding parts in FIG. 19 have the same reference numerals used in relation to FIG. 18. Also, while arrangement 310 of FIG. 19 is shown as having a conventional height, it could be of increased height as in FIG. 18. The forms of FIGS. 4 to 6, 7, 8 and 9 to 11 also could be modified to provide an increased height, to reduce shadow effects, if required, most preferably by increasing the height of the base component and the support means relative to the height of the rider bar in each case.

The principal difference in the arrangement of FIG. 19, relative to that of FIG. 18, is the form of engagement between casing 234 and side plates 35. As shown, casing 234 has a groove formed along each of its side faces. Also, each plate 35 has an inturned lower margin which locates in a respective one of those grooves. With this arrangement, plates 35 may be retained by bolts 39. However, the lower edge of each plate 35 also may be welded to casing 234, if required.

The rider bar assemblies of the invention, described with reference to FIGS. 4 to 19, may be used in a walking beam furnace or a pusher furnace. With each type of furnace, the weight of product to be supported usually is very substantial. Thus, a walking beam furnace may, for example, have a capacity for heating up to about 800 tonnes of steel slabs each of up to about 30 tonnes, with an output of about 400 tonnes per hour. Of course, the total load is carried by a sufficient number of fixed and movable beams of the furnace. Also, for any one slab, its weight is supported by up to about six or more rider bar assemblies for each beam. Thus, the total load borne by any one assembly at a given time is a quite minor part of the weight of a slab. However, surface to surface contact area between each rider bar and the slab also is small, such that the load per unit area for each rider bar and its assembly is extremely high.

The ceramic materials used for the rider bar and base component of the assemblies according to the present invention need to have sufficient high temperature resistance, with this being more critical in the case of the rider bar. However, given the high load per unit area to be accommodated, each ceramic is required to have a sufficient compressive strength. In the case of the rider bar for each assembly of FIGS. 4 to 6, 7, 8, 9 to 11, 18 and 19, the rider bar most preferably is of silicon carbide. However, other suitable ceramics are Sialon or, if cost permits, boron nitride.

The base component, as indicated, also is required to have a low thermal conductivity, to act as an insulator between the rider bar and each of the support means and, in particular, the beam. Alumina is a particularly suitable ceramic for use as the base component, and is preferred. Some grades of silicon carbide also have a sufficiently low level of thermal conductivity and, particularly where the base component is relatively thick (as in the case of FIG. 18), it can be of such grade of silicon carbide. Of course, such grade of silicon carbide also can be suitable for use as the ceramic for the rider bar. However, other ceramics of low thermal conductivity can be used for the base component, subject to them also having sufficient high temperature resistance and compressive strength. Also, a degree of porosity in the ceramic for the base component can be beneficial in reducing its thermal conductivity, subject to this not degrading compressive strength. The level of porosity may, for example, be up to about 30%, depending on the ceramic involved, but preferably is not more than about 10 to 15%.

In each case, the support means may be a suitable grade of steel, such as mild steel. In the case of FIGS. 18 and 19, the side plates 35 also can be of such steel although, subject to furnace temperatures, it may be beneficial or desirable to use plates 35 of stainless steel or a high temperature resistant steel such as used in the prior art for the rider bars.

As in each of the arrangements of FIGS. 4 to 6, 7, 8, 9 to 11, 18 and 19, it is preferred that the junction between the rider bar and base component, and between the base component and the casing or beam, be substantially horizontal and substantially planar to minimise or avoid lateral forces. Also, while in each arrangement illustrated, the beam has an upstanding fin and is of circular cross-section, either of these features is necessary. Thus, the beam can have a flat upper surface on which the rider bar assemblies are mounted, while the beam may, for example, be of rectangular section tubular form.

In each of the arrangements illustrated, the rider bar assemblies are of elongate form in plan view, and mounted transversely across the beam in the case of FIGS. 9 to 11, or longitudinally of the beam in the case of FIGS. 4 to 6, 7, 8, 18 and 19. As a consequence, the rider bars and base components are shown as being of elongate form in plan view. However as indicated, the assemblies are to accommodate very substantial loads. In order to more readily accommodate such loads, it in fact can be beneficial for the rider bars and the base components to be comprised of a plurality of separate parts each having a low aspect ratio, where possible as low as about one. That is the ratio of the length to the height can be reduced to the extent practical, so as to reduce bending moments able to be generated under load. For example, in the case of the arrangement 110 of FIGS. 4 to 6, in which the rider bar 114 has a significantly greater length than its height or width, it is desirable that the bar comprises three similar blocks which abut longitudinally along the assembly, as represented by lines A—A and B—B in FIGS. 4 and 5. The same can apply to the rider bar of other arrangements illustrated, as well as to the respective base components.

Finally, it is to be understood that various alternations, modifications and/or additions may be introduced into the constructions and arrangements of parts previously described without departing from the spirit or ambit of the invention.

We claim:

1. A rider bar assembly for a product support beam of a reheat furnace of the type suitable for reheating steel product such as slabs, blooms, bar stock and semi-finished products, wherein said rider bar assembly has a rider bar which defines an upper contact surface on which a product to be reheated is receivable, a base component which has an upper region with which a lower region of the rider bar is contiguous and support means by which the base component and the rider bar thereon are mountable on a product support beams of the furnace in which the product is to be reheated; the rider bar is formed of a high temperature resistant, solid ceramic material which is of low porosity and which has sufficient compressive strength for supporting part of the load of the product when the latter is received thereon and also on the rider bar of other assemblies mounted on the same and other beams; the base component is formed of a solid ceramic material which also has high temperature resistance and a compressive strength sufficient for supporting that part of the product load; the ceramic material of which the base component is formed has a low thermal conductivity whereby conduction of heat energy from the product, to the beam on which the assembly is mounted, is reduced; and wherein the ceramic material of which the rider bar is formed has a density in excess of 95% of its theoretical density.

2. The assembly of claim 1, wherein the contiguous region of the rider bar and the base component are substantially horizontally disposed, with the assembly mounted on the beam, whereby generation of lateral forces by the part of the product load is minimised.

3. The assembly of claim 2, wherein the contiguous regions define respective substantially planar, abutting surfaces.

4. The assembly of claim 1, wherein the base component has a substantially planar lower surface which, with the assembly mounted on the beam, is supported on an upwardly facing surface of the support means or of the beam and is substantially horizontally disposed, whereby generation of lateral forces by the part of the product load is minimised.

5. The assembly of claim 1, wherein the rider bar is separable from the base component.

6. The assembly of claim 1 wherein the ceramic of which the rider bar is formed comprises silicon carbide.

7. The assembly of claim 1 wherein the ceramic of which the base component is formed is selected from densified alumina and low thermal conductivity grades of silicon carbide.

8. The assembly of claim 1 wherein the base component encloses the support means along all sides, and extends over at least part of the height of the base component.

9. The assembly of claim 1 wherein the assembly is of elongate form in plan view and rider bar comprises a plurality of abutting, separable parts arranged along the base component.

10. The assembly of claim 8, wherein the support means defines a recess in which the base component and a lower portion of the rider bar is received.

11. A rider bar assembly for a product support beam of a reheat furnace of the type suitable for reheating steel product such as slabs, blooms, bar stock and semi-finished products, wherein said rider bar assembly has a rider bar which defines an upper contact surface on which a product to be reheated is receivable, a base component which has an upper region with which a lower region of the rider bar is contiguous and support means by which the base component and the rider bar thereon are mountable on a product support beam of the furnace in which the product is to be reheated; the rider bar is formed of a high temperature resistant, solid ceramic material which is of low porosity and which has sufficient compressive strength for supporting part of the load of the product when the latter is received thereon and also on the rider bar of other assemblies mounted on the same and other beams; the base component is formed of a solid ceramic material which also has high temperature resistance and a compressive strength sufficient for supporting that part of the product load; the ceramic material of which the base component is formed has a low thermal conductivity whereby conduction of heat energy from the product, to the beam on which the assembly is mounted, is reduced; and wherein the ceramic material of which the base component is formed is densified to achieve a level of porosity not exceeding 30%.

12. A rider bar assembly for a product support beam of a reheat furnace of the type suitable for reheating steel product such as slabs, blooms, bar stock and semi-finished products, wherein said rider bar assembly has a rider bar which defines an upper contact surface on which a product to be reheated is receivable, a base component which has an upper region with which a lower region of the rider bar is contiguous and support means by which the base component and the rider bar thereon are mountable on a product support beam of the furnace in which the product is to be reheated; the rider bar is formed of a high temperature resistant, solid ceramic material which is of low porosity and which has sufficient compressive strength for supporting part of the load of the product when the latter is received thereon and also on the rider bar of other assemblies mounted on the same and other beams; the base component is formed of a solid ceramic material which also has high temperature resistance and a compressive strength sufficient for supporting that part of the product load; the ceramic material of which the base component is formed has a low thermal conductivity whereby conduction of heat energy from the product, to the beam on which the assembly is mounted, is reduced; and wherein the ceramic material of which the rider bar is formed has a density in excess of 95% of its theoretical density.

13. A rider bar assembly for a product support beam of a reheat furnace of the type suitable for reheating steel product such as slabs, blooms, bar stock and semi-finished products, wherein said rider bar assembly has a rider bar which defines an upper contact surface on which a product to be reheated is receivable, a base component which has an upper region with which a lower region of the rider bar is contiguous and support means by which the base component and the rider bar thereon are mountable on a product support beam of the furnace in which the product is to be reheated; the rider bar is formed of a high temperature resistant, solid ceramic material which is of low porosity and which has sufficient compressive strength for supporting part of the load of the product when the latter is received thereon and also on the rider bar of other assemblies mounted on the same and other beams; the base component is formed of a solid ceramic material which also has high temperature resistance and a compressive strength sufficient for supporting that part of the product load; the ceramic material of which the base component is formed has a low thermal conductivity whereby conduction of heat energy from the product, to the beam on which the assembly is mounted, is reduced; and wherein the support means comprises a pair of support plates each of which extends along a respective side of the base component over at least part of the height of the latter.

14. A rider bar assembly for a product support beam of a reheat furnace of the type suitable for reheating steel product such as slabs, blooms, bar stock and semi-finished products, wherein said rider bar assembly has a rider bar which defines an upper contact surface on which a product to be reheated is receivable, a base component which has an upper region with which a lower region of the rider bar is contiguous and support means by which the base component and the rider bar thereon are mountable on a product support beam of the furnace in which the product is to be reheated; the rider bar is formed of a high temperature resistant, solid ceramic material which is of low porosity and which has sufficient compressive strength for supporting part of the load of the product when the latter is received thereon and also on the rider bar of other assemblies mounted on the same and other beams; the base component is formed of a solid ceramic material which also has high temperature resistance and a compressive strength sufficient for supporting that part of the product load; the ceramic material of which the base component is formed has a low thermal conductivity whereby conduction of heat energy from the product, to the beam on which the assembly is mounted, is reduced; and wherein the support means defines a recess in which the base component and a lower portion of the rider bar is received.

15. A rider bar assembly for a product support beam of a reheat furnace of the type suitable for reheating steel product such as slabs, blooms, bar stock and semi-finished products, wherein said rider bar assembly has a rider bar which defines an upper contact surface on which a product to be reheated is receivable, a base component which has an upper region with which a lower region of the rider bar is contiguous and support means by which the base component and the rider bar thereon are mountable on a product support beam of the furnace in which the product is to be reheated; the rider bar is formed of a high temperature resistant, solid ceramic material which is of low porosity and which has sufficient compressive strength for supporting part of the load of the product when the latter is received thereon and also on the rider bar of other assemblies mounted on the same and other beams; the base component is formed of a solid ceramic material which also has high temperature resistance and a compressive strength sufficient for supporting that part of the product load; the ceramic material of which the base component is formed has a low thermal conductivity whereby conduction of heat energy from the product, to the beam on which the assembly is mounted, is reduced; and wherein the assembly is of elongate form in plan view and each of the rider bar and the base component is of integral form.

16. A rider bar assembly for a product support beam of a reheat furnace of the type suitable for reheating steel product such as slabs, blooms, bar stock and semi-finished products, wherein said rider bar assembly has a rider bar which defines an upper contact surface on which a product to be reheated is receivable, a base component which has an upper region with which a lower region of the rider bar is contiguous and support means by which the base component and the rider bar thereon are mountable on a product support beam of the furnace in which the product is to be reheated; the rider bar is formed of a high temperature resistant, solid ceramic material which is of low porosity and which has sufficient compressive strength for supporting part of the load of the product when the latter is received thereon and also on the rider bar of other assemblies mounted on the same and other beams; the base component is formed of a solid ceramic material which also has high temperature resistance and a compressive strength sufficient for supporting that part of the product load; and wherein the ceramic material of which the base component is formed has a low thermal conductivity whereby conduction of heat energy from the product, to the beam on which the assembly is mounted, is reduced; the assembly further including a respective pad of high temperature resistant, thermally conducting material at each side of the assembly, wherein the pads are mounted in relation to the mounting means and are mutually inclined to each other so as to diverge from the rider bar towards the mounting means.

17. A rider bar assembly for a product support beam of a reheat furnace of the type suitable for reheating steel product such as slabs, blooms, bar stock and semi-finished products, wherein said rider bar assembly has a rider bar which defines an upper contact surface on which a product to be reheated is receivable, a base component which has an upper region with which a lower region of the rider bar is contiguous and support means by which the base component and the rider bar thereon are mountable on a product support beam of the furnace in which the product is to be reheated; the rider bar is formed of a high temperature resistant, solid ceramic material which is of low porosity and which has sufficient compressive strength for supporting part of the load of the product when the latter is received thereon and also on the rider bar of other assemblies mounted on the same and other beams; the base component is formed of a solid ceramic material which also has high temperature resistance and a compressive strength sufficient for supporting that part of the product load; the ceramic material of which the base component is formed has a low thermal conductivity whereby conduction of heat energy from the product, to the beam on which the assembly is mounted, is reduced; and wherein the assembly further includes a respective pad of high temperature resistant. thermally conducting material at each side of the assembly, wherein the pads are mounted in relation to the mounting means and are mutually inclined to each other so as to diverge from the rider bar towards the mounting means and wherein thermal insulation material is provided in a respective cavity between each pad and the mounting means.

* * * * *